US007273340B2

(12) United States Patent
Arrez et al.

(10) Patent No.: US 7,273,340 B2
(45) Date of Patent: Sep. 25, 2007

(54) HEAVY DUTY CART LIFTER

(75) Inventors: Ramiro Arrez, Orland Park, IL (US); Carlos Arrez, Berwyn, IL (US); James Rimsa, Countryside, IL (US)

(73) Assignee: Perkins Manufacturing Company, LaGrange, IL (US)

( * ) Notice: Subject to any disclaimer, the term of this patent is extended or adjusted under 35 U.S.C. 154(b) by 302 days.

(21) Appl. No.: 10/767,041

(22) Filed: Jan. 29, 2004

(65) Prior Publication Data

US 2005/0169734 A1 Aug. 4, 2005

(51) Int. Cl.
*B65F 3/02* (2006.01)

(52) U.S. Cl. ..... 414/421; 414/546

(58) Field of Classification Search ..... 414/421, 414/419, 424; 415/425, 546
See application file for complete search history.

(56) References Cited

U.S. PATENT DOCUMENTS

| | | | |
|---|---|---|---|
| 1,763,499 | A | 6/1930 | Bolger |
| 2,480,959 | A | 9/1949 | Presnell |
| 2,824,658 | A | 2/1958 | Beasley |
| 3,032,216 | A | 5/1962 | McCarthy |
| 3,040,919 | A | 6/1962 | Nolan |
| 3,136,436 | A | 6/1964 | Erlinder et al. |
| 3,147,870 | A | 9/1964 | Urban et al. |
| 3,170,580 | A | 2/1965 | Soyko |
| 3,211,312 | A | 10/1965 | Miller |
| 3,270,902 | A | 9/1966 | Breault |
| 3,279,633 | A | 10/1966 | Evers |
| 3,327,876 | A | 6/1967 | Kolling |
| 3,516,562 | A | 6/1970 | Knight |
| 3,576,265 | A | 4/1971 | de Cordova et al. |
| 3,662,910 | A | 5/1972 | Herpich et al. |
| 3,730,365 | A | 5/1973 | Herpich |
| 3,732,997 | A | 5/1973 | Reavis et al. |
| 3,738,516 | A | 6/1973 | Wells |
| 3,747,785 | A | 7/1973 | Dahlin |

(Continued)

FOREIGN PATENT DOCUMENTS

| | | |
|---|---|---|
| AT | 243183 | 2/1965 |

(Continued)

OTHER PUBLICATIONS

Perkins Mfg. Brochure: "The Original Rotary Tuckaway," Model D6080-20K, (2 pages).

(Continued)

*Primary Examiner*—Charles A Fox
(74) *Attorney, Agent, or Firm*—Cook, Alex, McFarron, Manzo, Cummings & Mehler, Ltd.

(57) ABSTRACT

A cart lifter is disclosed for lifting and inverting a refuse collection cart. The preferred cart lifter comprises a base and preferably has a lift member pivotally mounted with respect to the base for engaging the upper engagement surface of a refuse cart and a hook for capturing the lower engagement surface on the cart. An actuator is mounted to the base and is operatively attached to the lift member and hook for moving them between a lower and a raised and inverted positions. An actuator arm pivotally connects the base to the hook and the hook is mounted for movement between a position for capturing the lower engagement surface of the collection cart and a retracted position.

6 Claims, 5 Drawing Sheets

U.S. PATENT DOCUMENTS

| | | | |
|---|---|---|---|
| 3,762,586 | A | 10/1973 | Updike, Jr. |
| 3,773,197 | A | 11/1973 | Blakeley et al. |
| 3,804,277 | A | 4/1974 | Brown et al. |
| 3,822,802 | A | 7/1974 | Evans, Jr. |
| 3,823,973 | A | 7/1974 | Ramer |
| 3,837,512 | A | 9/1974 | Brown |
| 3,841,508 | A | 10/1974 | Ebeling et al. |
| 3,844,434 | A | 10/1974 | Blakeley et al. |
| 3,861,547 | A | 1/1975 | Sink, Sr. |
| 3,884,376 | A | 5/1975 | Rivers |
| 3,894,642 | A | 7/1975 | Shive |
| 3,901,255 | A | 8/1975 | Pettit |
| 3,931,901 | A | 1/1976 | Jones |
| 3,944,092 | A | 3/1976 | Ebeling et al. |
| 3,954,194 | A | 5/1976 | Stedman |
| 3,964,624 | A | 6/1976 | Werder |
| 4,042,137 | A | 8/1977 | Hughes et al. |
| 4,057,156 | A | 11/1977 | Thompson et al. |
| 4,090,626 | A | 5/1978 | Ebeling et al. |
| 4,091,944 | A | 5/1978 | Gollnick |
| 4,096,959 | A | 6/1978 | Schaffer |
| 4,113,125 | A | 9/1978 | Schiller |
| 4,175,903 | A | 11/1979 | Carson |
| 4,219,298 | A | 8/1980 | Stragier et al. |
| 4,227,849 | A | 10/1980 | Worthington |
| 4,230,359 | A | 10/1980 | Smith |
| 4,237,857 | A | 12/1980 | Sharp, Sr. |
| 4,295,776 | A | 10/1981 | Payne et al. |
| 4,313,707 | A | 2/1982 | Bingman et al. |
| 4,345,868 | A | 8/1982 | Rizzo et al. |
| 4,348,147 | A | 9/1982 | Helm |
| 4,363,588 | A | 12/1982 | Stickney |
| 4,365,922 | A | 12/1982 | Borders |
| 4,372,726 | A | 2/1983 | Lutz |
| 4,401,407 | A | 8/1983 | Breckenridge |
| 4,422,814 | A | 12/1983 | Borders |
| 4,427,333 | A | 1/1984 | Ebeling |
| 4,435,117 | A | 3/1984 | House |
| 4,450,828 | A | 5/1984 | Oaken et al. |
| 4,461,607 | A | 7/1984 | Smith |
| 4,461,608 | A | 7/1984 | Boda |
| 4,479,751 | A | 10/1984 | Wyman et al. |
| 4,527,939 | A | 7/1985 | Suarez |
| 4,538,951 | A | 9/1985 | Yeazel et al. |
| 4,543,028 | A | 9/1985 | Bell et al. |
| 4,548,542 | A | 10/1985 | Reese |
| 4,557,658 | A | 12/1985 | Lutz |
| 4,566,840 | A | 1/1986 | Smith |
| 4,575,300 | A | 3/1986 | George |
| 4,597,710 | A | 7/1986 | Kovats |
| 4,613,271 | A | 9/1986 | Naab |
| 4,669,940 | A | 6/1987 | Englehardt et al. |
| 4,673,327 | A | 6/1987 | Knapp |
| 4,687,405 | A | 8/1987 | Olney |
| 4,699,557 | A | 10/1987 | Barnes |
| 4,708,570 | A | 11/1987 | Smith et al. |
| 4,715,767 | A | 12/1987 | Edelhoff et al. |
| 4,722,658 | A | 2/1988 | Wurtz et al. |
| 4,726,726 | A | 2/1988 | Dossena et al. |
| 4,741,658 | A | 5/1988 | Zelinka et al. |
| 4,773,812 | A | 9/1988 | Bayne et al. |
| 4,844,682 | A | 7/1989 | Edelhoff |
| 4,872,801 | A | 10/1989 | Yeazel et al. |
| 4,909,564 | A | 3/1990 | Pfeifer et al. |
| 4,911,600 | A | 3/1990 | Zelinka et al. |
| 4,936,732 | A | 6/1990 | Naab et al. |
| 4,966,514 | A | 10/1990 | Knapp |
| 4,983,092 | A | 1/1991 | Richards |
| 4,992,018 | A | 2/1991 | Prout et al. |
| 5,002,450 | A | 3/1991 | Naab |
| 5,007,786 | A | 4/1991 | Bingman |
| 5,015,142 | A | 5/1991 | Carson |
| 5,015,143 | A | 5/1991 | Carson |
| 5,018,929 | A | 5/1991 | Carson |
| 5,024,573 | A | 6/1991 | Redding et al. |
| 5,026,104 | A | 6/1991 | Pickrell |
| 5,026,241 | A | 6/1991 | Wyman |
| 5,028,196 | A | 7/1991 | Richards |
| 5,035,563 | A | 7/1991 | Mezey |
| 5,049,026 | A | 9/1991 | Bingman et al. |
| 5,056,979 | A | 10/1991 | Niederer |
| 5,069,593 | A | 12/1991 | Zelinka et al. |
| 5,071,303 | A | 12/1991 | Carson |
| 5,071,307 | A | 12/1991 | Carson |
| 5,092,731 | A | 3/1992 | Jones et al. |
| 5,098,250 | A | 3/1992 | Carson |
| 5,114,304 | A | 5/1992 | Edelhoff et al. |
| 5,163,805 | A | 11/1992 | Mezey |
| 5,205,698 | A | 4/1993 | Mezey |
| 5,209,537 | A | 5/1993 | Smith et al. |
| 5,230,393 | A | 7/1993 | Mezey |
| 5,257,877 | A | 11/1993 | Zelinka et al. |
| 5,266,000 | A | 11/1993 | LeBlanc |
| 5,303,841 | A | 4/1994 | Mezey |
| 5,308,211 | A | 5/1994 | Bayne |
| 5,333,984 | A | 8/1994 | Bayne et al. |
| 5,344,272 | A | 9/1994 | Nuyts |
| 5,360,310 | A | 11/1994 | Jones et al. |
| 5,391,039 | A | 2/1995 | Holtom |
| 5,466,110 | A | 11/1995 | Redding |
| 5,470,187 | A | 11/1995 | Smith et al. |
| 5,482,180 | A | 1/1996 | Smith et al. |
| 5,484,245 | A | 1/1996 | Zopf |
| 5,505,576 | A | 4/1996 | Sizemore et al. |
| 5,513,942 | A | 5/1996 | Pickrell |
| 5,551,824 | A | 9/1996 | Zanzig et al. |
| 5,562,386 | A | 10/1996 | Browning |
| 5,601,392 | A | 2/1997 | Smith et al. |
| 5,607,277 | A | 3/1997 | Zopf |
| 5,639,201 | A | 6/1997 | Curotto |
| 5,720,588 | A | 2/1998 | Graves |
| 5,720,589 | A | 2/1998 | Christenson et al. |
| 5,755,547 | A | 5/1998 | Flerchinger et al. |
| 5,769,592 | A | 6/1998 | Christenson |
| 5,775,867 | A | 7/1998 | Christenson |
| 5,791,861 | A | 8/1998 | Seelig |
| 5,797,715 | A | 8/1998 | Christenson |
| 5,807,056 | A | 9/1998 | Osborn et al. |
| 5,813,824 | A | 9/1998 | Zanzig et al. |
| 5,829,944 | A | 11/1998 | Szinte |
| 5,833,428 | A | 11/1998 | Szinte |
| 5,853,277 | A | 12/1998 | Everhart |
| 5,890,865 | A | 4/1999 | Smith et al. |
| 6,059,511 | A | 5/2000 | Anderson et al. |
| 6,095,744 | A | 8/2000 | Harrison |
| 6,139,244 | A | 10/2000 | VanRaden |
| 6,158,945 | A | 12/2000 | Anderson |
| 6,167,795 | B1 | 1/2001 | Bayne et al. |
| 6,183,185 | B1 | 2/2001 | Zanzig et al. |
| 6,293,863 | B1 | 9/2001 | Carr et al. |
| 6,325,587 | B1 | 12/2001 | Wysocki et al. |
| 6,357,988 | B1 | 3/2002 | Bayne |
| 6,413,031 | B1 | 7/2002 | Yakley et al. |
| 6,439,667 | B1 | 8/2002 | Weets et al. |
| 6,503,045 | B2 | 1/2003 | Arrez et al. |
| 6,551,046 | B1 | 4/2003 | Dorrington |
| 2001/0046430 | A1 | 11/2001 | Bayne |
| 2002/0119034 | A1 | 8/2002 | Arrez |
| 2002/0141854 | A1 | 10/2002 | Arrez |
| 2002/0141855 | A1 | 10/2002 | Arrez |

2003/0099529 A1 5/2003 Arrez

FOREIGN PATENT DOCUMENTS

| | | |
|---|---|---|
| BE | 510235 | 4/1952 |
| CA | 622499 | 6/1961 |
| CH | 358747 | 1/1962 |
| CH | 453203 | 6/1968 |
| DE | 811 456 | 8/1951 |
| DE | 844 262 | 3/1952 |
| DE | 1 226 035 | 9/1966 |
| DE | 1 236 403 | 3/1967 |
| DE | 2 146 653 | 3/1967 |
| DE | 1531 763 | 1/1970 |
| DE | 2 051 270 | 10/1970 |
| DE | 30 24 081 | 1/1981 |
| DK | 82300 | 6/1954 |
| EP | 0 078 011 | 4/1983 |
| EP | 0 312 900 | 4/1989 |
| EP | 0 405 428 | 1/1991 |
| EP | 575 867 | 12/1993 |
| FR | 2 272 002 | 12/1975 |
| FR | 2 459 779 | 1/1981 |
| FR | 2 479 783 | 10/1981 |
| FR | 2 500 425 | 8/1982 |
| GB | 291709 | 6/1928 |
| GB | 2 078 196 | 1/1982 |
| GB | 2 080 757 A | 2/1982 |
| GB | 2 188 302 | 9/1987 |
| SU | 751794 | 9/1980 |
| SU | 1 253 892 | 8/1986 |
| WO | WO83/03242 | 9/1983 |
| WO | WO91/00231 | 1/1991 |
| WO | WO91/05721 | 5/1991 |
| WO | WO92/01612 | 2/1992 |
| WO | WO93/25457 | 12/1993 |
| WO | WO94/21540 | 9/1994 |

OTHER PUBLICATIONS

Zöller-Kipper GMBH Brochure "Zöller System," (11 pages).

Bayne Brochure Thinline® Grabber Lifter, Model GTLS 1110, undated, (2 pages).

Lifting Mechanism for a Sanitation Vehicle, U.S. Appl. No. 378,823, filed May 12, 1982, now abandoned (bearing production Nos. B984-1005), with photographs (dated Dec. 1981) (bearing production Nos. B1082-1097), photographs of a present version of the above cited reference (bearing production Nos. B1098-1110A), and other related documents (bearing production Nos. 935-937, 939, 941-947, 948-977, 979, 981, 983, 1006-1025, and 1111-1125).

Refuse Removal Systems, Inc., "Waste Wheeler," Waste Age, 1982 (with photographs of the device bearing production Nos. B913-922).

McKagen, World Wastes, "Supercan! Can . . . And Does," Jun. 1983, pp. 24-26.

Waste Age, Mar. 1982, pp. 31-33.

Zarn Model "D" sales brochure, printed prior to Mar. 20, 2002.

Taskmaster Lifter features/specifications from: http://www.baynethinline.com/products-taskmaster.htm.

Arrez et al., U.S. Appl. No. 10/691,989, filed Oct. 23, 2003, entitled "Receptacle Lifter With Retractable Gripper Arms."

U.S. Appl. No. 10/718,336, filed Nov. 20, 2003, entitled "Front Mounted Lifter for Front Load Vehicle."

Rubbermaid "Mobile Toter."

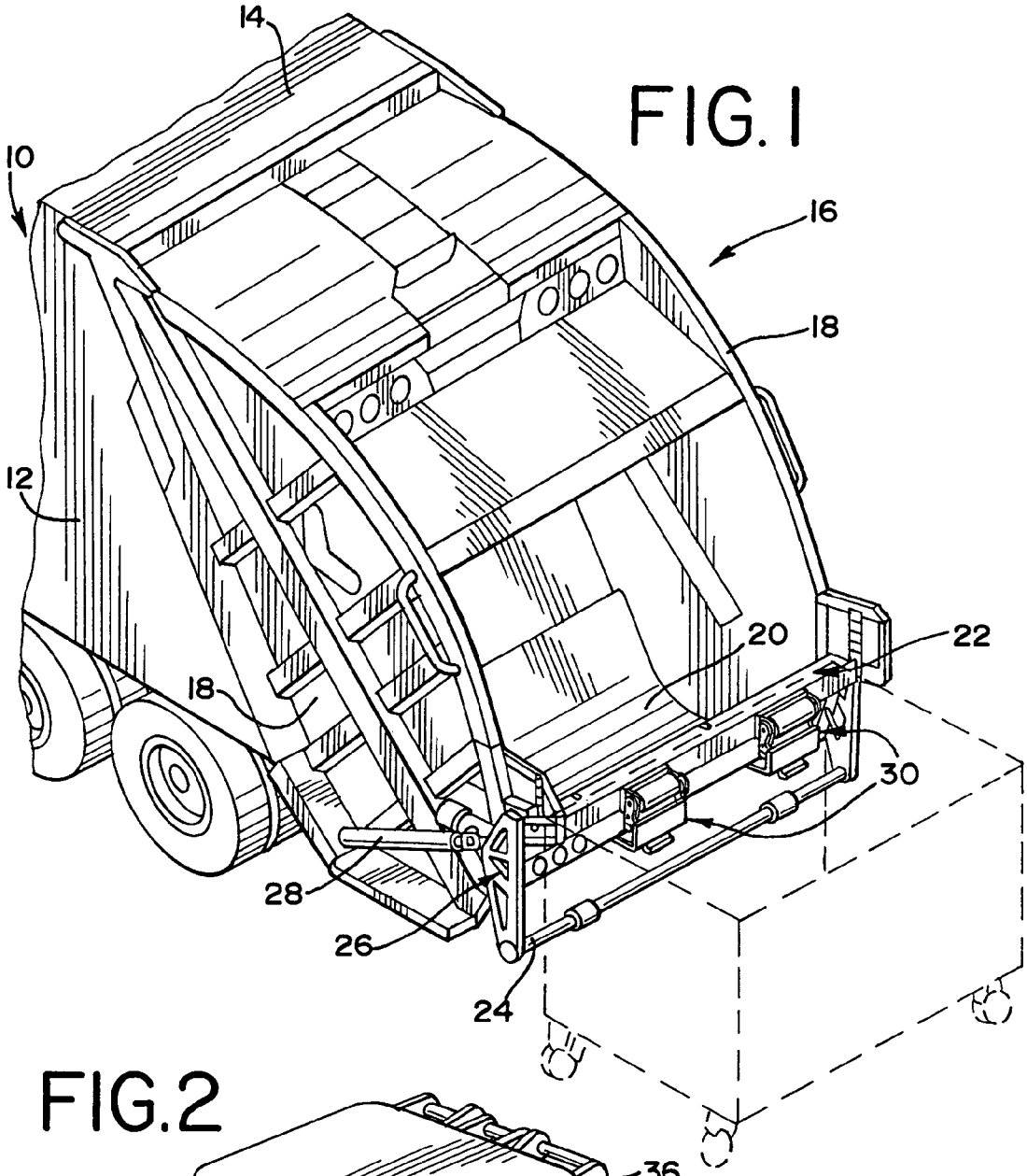
FIG. 1
FIG. 2
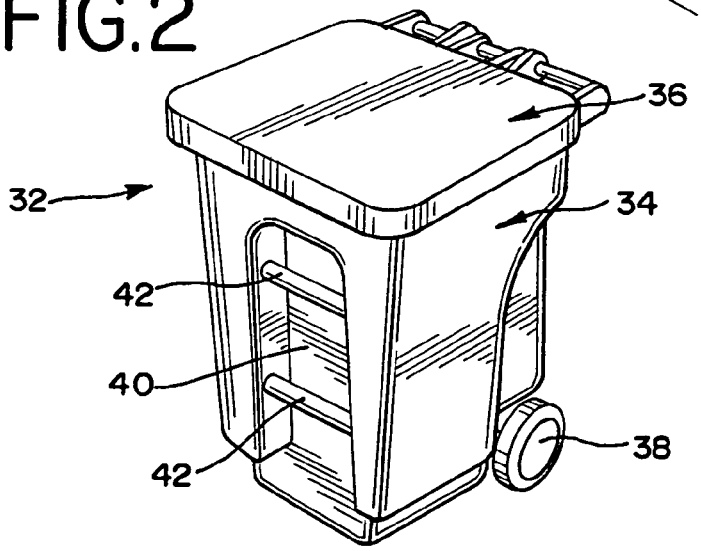

30
44
46
48
52
54
56
58
60
62
64
66
68
70
72
74
76
78
80
82
84
86

HEAVY DUTY CART LIFTER

BACKGROUND OF THE INVENTION

The present invention generally relates to lifters for refuse collection containers and, more specifically, to lifters for lifting, tilting and dumping residential-style refuse containers.

It has been a common practice in the refuse collection industry for a single refuse receiving vehicle to service both residential and commercial establishments. Traditionally, residential refuse receptacles were approximately 30 gallon containers, which the vehicle operator lifted by hand to dump into the refuse receiving cavity of the vehicle. In contrast, commercial refuse containers are typically much larger steel containers often with a volume of two cubic yards or greater, and are commonly referred to as "dumpsters." These containers are typically pivot-dumped into the refuse receiving cavity by mechanically tipping the container over the rear edge of the refuse receiving cavity. Such containers are usually tipped by a cable and winch, or by a hydraulically actuated tipper bar that rotates and lifts the container.

More recently, it has become popular in some residential areas to use larger, plastic roll-out refuse receptacles that have a capacity of approximately 90 gallons. Typically, these refuse receptacles have two lifting handles or bars along a common exterior receptacle wall and two wheels for convenience in moving the receptacle. As a result of the greatly increased size over prior residential receptacles, the roll-out refuse residential receptacles are not easily lifted by hand. This has given rise to the development and use of refuse receptacle lifters specifically made for these larger roll-out receptacles.

Examples of commercially successful refuse receptacle lifters are the TuckAway lifters manufactured by Perkins Manufacturing Company of LaGrange, Ill., and shown variously in U.S. Pat. Nos. 4,741,658, 4,911,600, 5,024,573, 5,069,593, 5,257,877, 5,466,110, and 6,503,045. These lifters typically include a carriage for holding the refuse receptacle that can be retracted to a lower position, generally underneath the sill of the hopper of a rear-loading refuse collection vehicle where they do not interfere with the dumping of commercial containers by a cable and winch, and, in some models, by the operation of a tipper bar.

One issue that recurs with lifters that retract to a stowed position beneath the hopper sill is the ground clearance that is needed as it moves to and from the stowed position, and when it is in the stowed position. This is exacerbated by the hooks used to engage the lifting handles of the refuse receptacle, which typically protrude beyond the face plate of the carriage and, thus, extend downwardly when the lifter is in its retracted position.

In addition, durability, reliability, and simplicity of manufacture and operation are highly desirous attributes of a lifter due to the environment in which they are used and the abuse to which they are subjected. Continuing efforts are being made to develop lifters having one more of these attributes.

SUMMARY OF THE INVENTION

These objects, as well as others that will become apparent upon reference to the following detailed description and accompanying drawings, are met by a cart lifter for lifting and inverting a refuse collection cart in which the cart has spaced-apart upper and lower engagement surfaces. One version or embodiment of the cart lifter of the present invention comprises a base, which is typically secured to the sill area of a rear-loading refuse collection-truck. The lifter includes a face plate pivotally mounted with respect thereto for engaging a refuse cart and moving between a first, lower position and a second, raised and inverted position for dumping the contents of the cart into the bin or hopper of the refuse collection vehicle. An actuator is mounted to the base and operatively attached to the face plate for moving the face plate between the lower and the raised and inverted positions. In the preferred embodiment, the actuator comprises a rotatory actuator having a housing that is carried by the base and a rotatable output shaft to which the face plate is directly or indirectly mounted. A lift member is secured to the face plate for engaging the upper engagement surface of the collection cart and a latch assembly is mounted to the face plate for capturing the lower engagement surface. The latch assembly in this embodiment comprises a track carried by the face plate with a slide moveably mounted in the track. An engagement member such as a hook is pivotally carried by the slide for movement between a position for capturing the lower engagement surface of the collection cart and a retracted position. The hook is biased towards the capturing position. An actuator arm is provided that has one end pivotally carried by the base, or the actuator housing, and the other end operatively connected to the slide. Optionally, a support or bracket may be secured to the base for pivotally mounting one end of the actuator arm. Consequently, when face plate is moved from the raised and inverted position to the lower position, the actuator arm moves the slide along the track to cause the hook to engage a portion of the face plate to move the hook to the retracted position. This may increase the ground clearance of the lifting device as it moved to the lower position.

In the preferred embodiment, the face plate may be pivotally connected to the output shaft of the rotatary actuator by a lift arm. The lift arm may comprise two parts pivotally connected to each other and secured in an operating position by shear bolts, a detent arrangement, or other force-relief mechanism, to provide a break-away feature, should the lifter collide with obstacles, road debris or other potentially destructive objects.

Other objects and advantages will become apparent upon reference to the following detailed description and accompanying drawings.

DESCRIPTION OF THE DRAWINGS

FIG. 1 is a fragmentary perspective view of the rear end of a rear-loading refuse collection vehicle including a lifter in accordance with the present invention.

FIG. 2 is a perspective view of a typical residential refuse collection container to be used with the lifter of the present invention.

DETAILED DESCRIPTION OF THE PREFERRED EMBODIMENT

Figure 3:
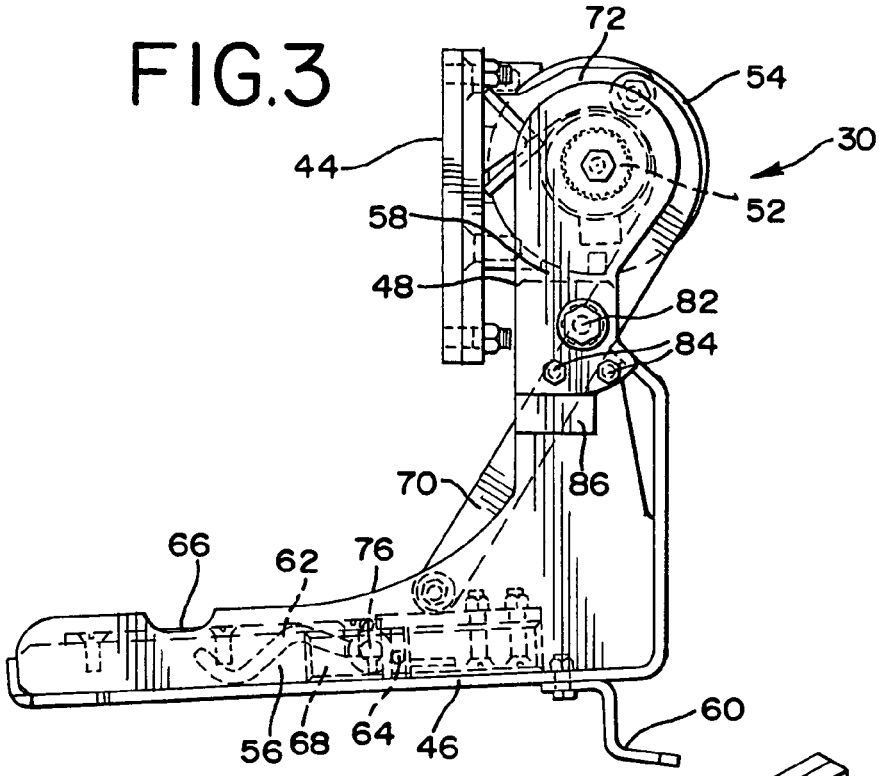
FIG. 3 is a side view of a lifter according to the present invention showing the lifter in its lower or stowed position.

With reference to FIG. 1, there is seen the rear portion of a typical rear-loading refuse collection truck, generally indicated by 10. The truck includes a refuse collection body defined generally by a pair of side walls 12, a top wall 14, and bottom wall (not seen). A rear-load hopper assembly, generally indicated by 16, is mounted at back of the collection body and includes side walls 18, and a curved bottom hopper wall 20. The bottom hopper wall 20 slopes upwardly toward a rearward sill or sill edge 22, over which refuse dumped into the collection hopper.

The rear load collection truck illustrated in FIG. 1 is adapted for dumping both very large, multi-cubic yard containers, commonly referred to as dumpsters, one of which is shown in dashed lines in FIG. 1, as well as much smaller residential-style containers, such as that shown in FIG. 2. For dumping the large containers, a tipper or kick bar 24 is pivotally attached to the back of the truck by a bracket 26 that is rotated by a pair of hydraulic cylinders 28 (one shown).

When a large container is to be dumped, the container is rolled into position adjacent the sill area of the collection truck. A trunnion bar, which extends along one edge of the container is captured by a latching mechanism, or in a slot that extends along the sill of the truck. The container is then lifter and tilted by rotating it about the trunnion bar by the tipper bar 24. Alternatively, the truck may have a cable and winch for lifter and tilting the container.

For dumping smaller residential style refuse collection containers, the refuse collection truck 10 includes a lifter, generally designated 30, embodying the present the invention, mounted at rear of the hopper. While only one lifter 30 is illustrated in connection with the collection truck 10, two could used. While the lifter 30 is shown in connection with the particular truck, this is solely for purposes of illustrated. The lifter 30 may also be used on trucks that use a cable and winch system, or on trucks devoted solely to residential pick-up and having no capability of lifting dumpsters. In addition, the lifter 30 may be used on side load trucks, or on larger multi-yard containers with suitable hydraulic or other power attachments.

A typical residential refuse container or cart 32 for use in connection with the present invention is shown in FIG. 2. The typical container 32 is made of rigid plastic construction with a body 34 and hinged lid 36. A pair of wheels 38 allow the container to be conveniently moved curb side, or to another pick-up location. The front side of the container includes a generally recessed area 40 to accommodate lifter units on the refuse collection vehicle. For cooperation with such lifters, a pair of parallel, spaced-apart engagement surfaces 42 are formed or secured in the container body in the recessed area 40. As illustrated, the engagement surfaces 42 may comprise parallel, spaced-apart lift bars 42 that are firmly secured to the container body in the recessed area. Other residential containers do not have bars, but have comparable functional structures molded into or otherwise attached to the container. The lid 36 is hingedly connected to the body, so that the lid is naturally open by gravity when the container is in routed for dumping. While a particular embodiment of a collection cart is shown in FIG. 2, they are available in a variety of styles and designs, and the present invention is not limited to any particular style or design of refuse collection container.

Figure 4:
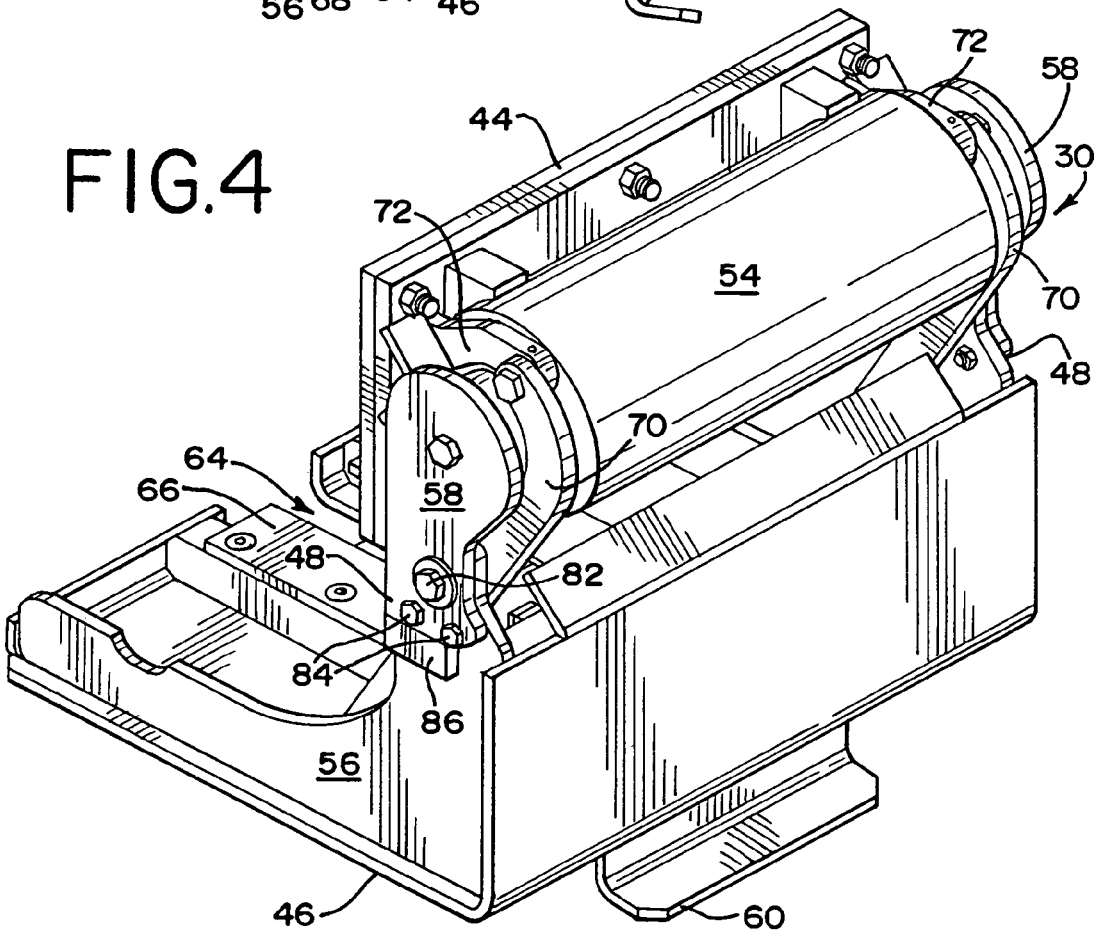
FIG. 4 is a perspective view according to the present invention with the lifter shown in its lower or stowed position.
Figure 5:
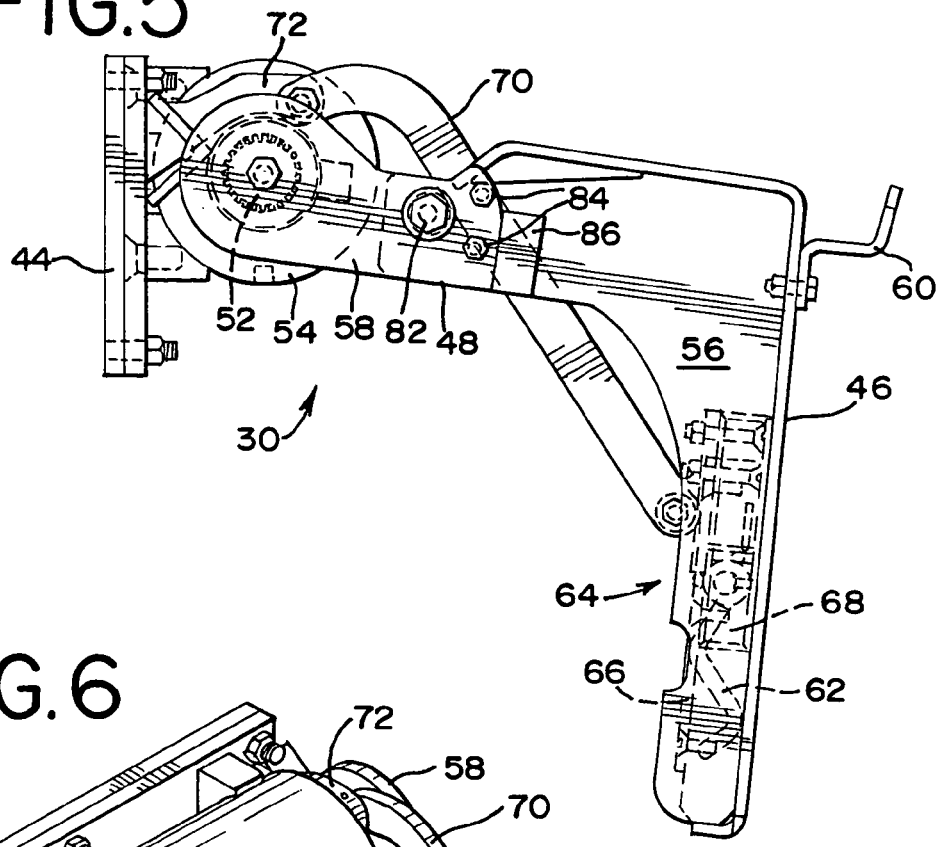
FIG. 5 is a side view of the lifter of FIG. 3 with the lifter in a cart-engaging position in which the upper hook is positioned to engage under the upper engagement surface of a refuse collection cart.
Figure 6:
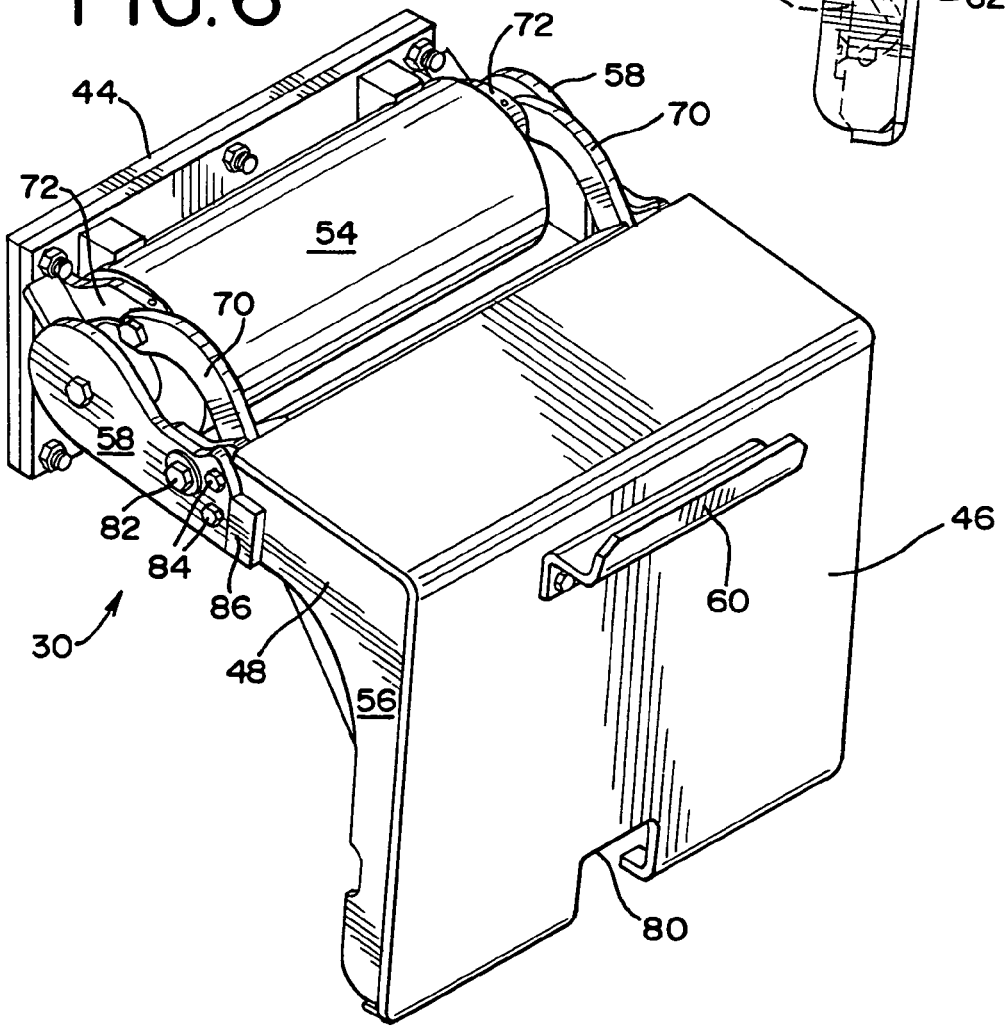
FIG. 6 is a perspective view of the lifter in the cart-engaging position of FIG. 5.
Figure 8:
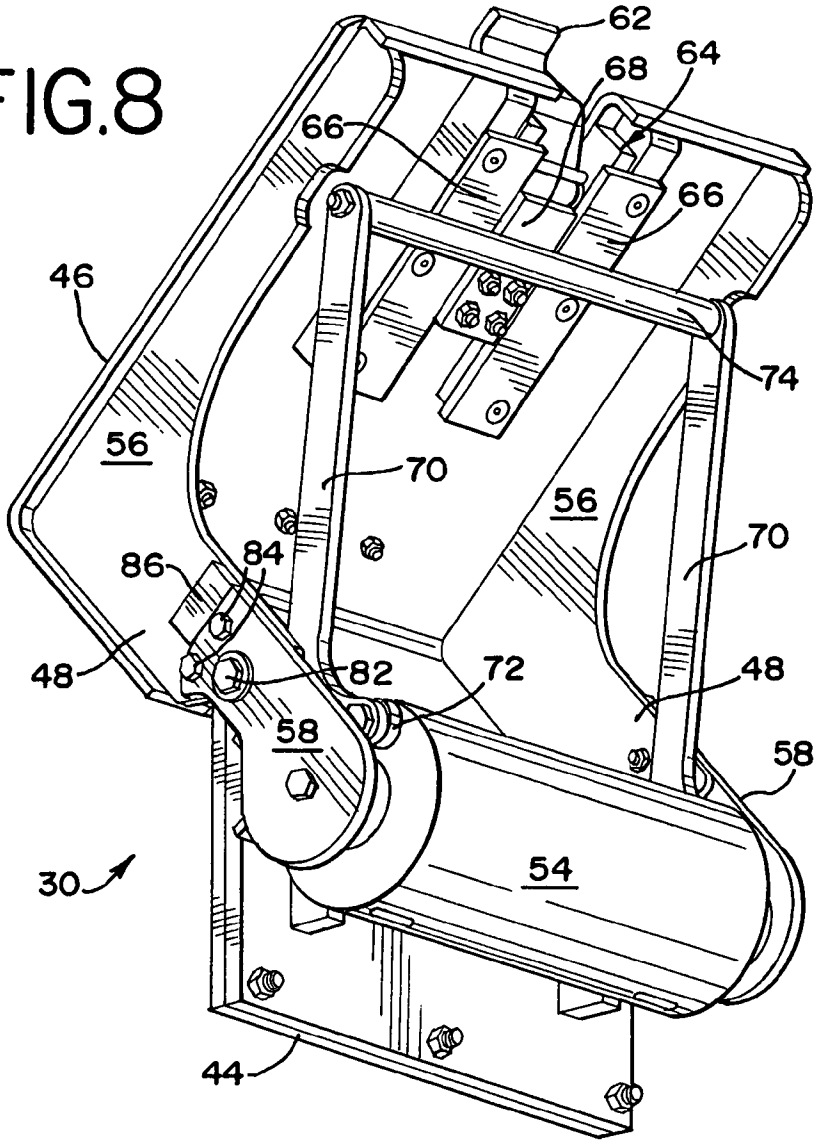
FIG. 8 is a perspective view of the cart lifter in the raised and inverted position of FIG. 7, illustrating the underside of the face plate.
Figure 7:
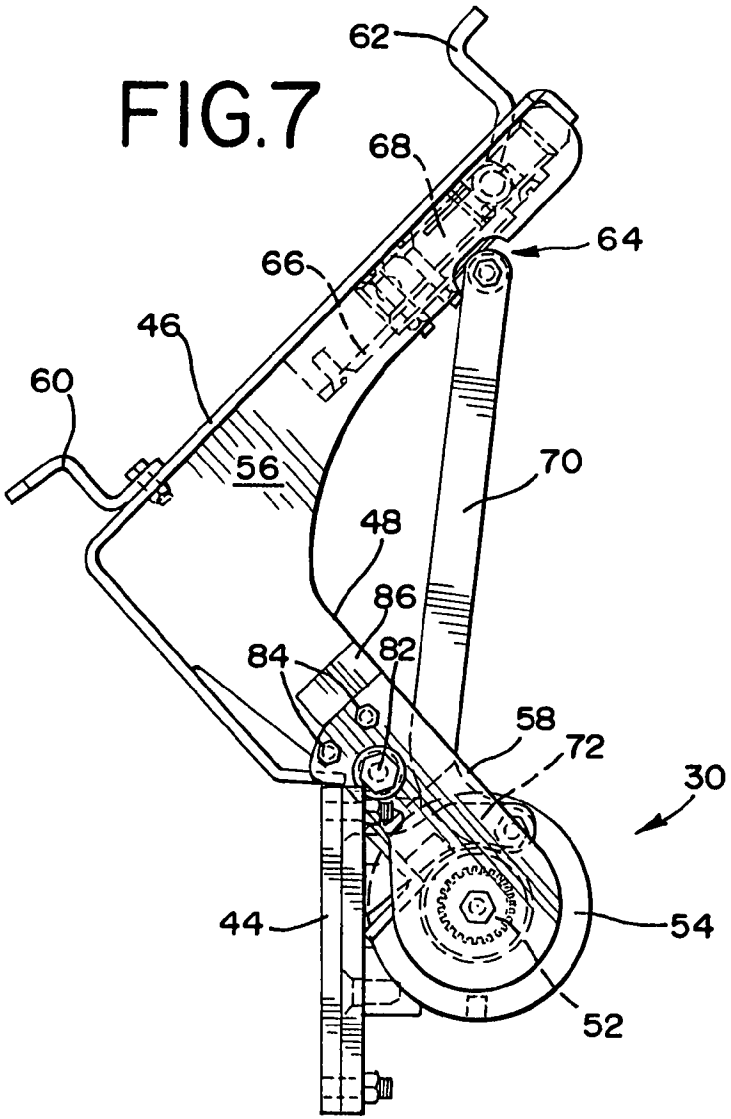
FIG. 7 is a side view of the lifter in the raised and inverted position for dumping a refuse collection cart.

Turning to FIGS. 3-10, there is seen in detail the cart lifter 30 according to the present invention. FIGS. 3 and 4 show the cart lifter 30 in the lower or stowed position. FIGS. 5 and 6 show the cart lifter 32 generally in the cart-engaging position. FIGS. 7 and 8 show the cart lifter 30 in the raised and inverted dumping position. The illustrated lifter 30 includes a base 44 comprising a steel plate by which the cart lifter 30 is secured to the truck in the vicinity of the edge or sill of the hopper. The lifter 30 includes a face plate or carriage 46 against which the collection cart 32 is positioned for dumping. A pair of lift arms 48 secure the carriage 46 to the opposite ends of a rotatable output shaft 52 of a hydraulic actuator 54. Alternatively, a single lift arm can be utilized, which would be connected to the output shaft that extends through only one end of the hydraulic drive unit.

The hydraulic drive unit 54 may be of any suitable design and may be, for example, a rotary hydraulic motor, although other non-rotary drives or non-hydraulic drives may be used. Most preferably, the drive unit 54 is an HS series helical hydraulic shaft rotary drive unit, as supplied by Helac Corporation of Enumclaw, Wash. These drive units are available in a variety of torque capabilities, and model HS-25k is believed to be suitable for the present application. The drive unit 54 is attached, as by welding or bolting, either directly or indirectly to the mounting or base plate 44. It is also possible that the actuator 54 may be attached to another structure, instead of directly to the base itself, which other structure is either directly mounted to the base or indirectly mounted to the base through one or more intermediate structures. Accordingly, when it is stated that a particular component is mounted to or carried by the base plate, it is intended that such a phrase be broadly construed to mean both directly mounting and indirectly mounting, where intermediate structures may be located between the particular component and the base plate.

The face plate 46 has a generally L-shape, when viewed from its side edge (as in FIG. 3), and is secured to a lower portion 56 of the lift arm by, e.g., welding. The lower portion 56 of the lift arm 48 is secured by a break away attachment, which will be discussed in greater detail below, to an upper portion of the lift arm 58 which is attached to the output shaft 52 of the drive unit 54. The carriage 46 includes an upper hook which is fixed thereto for engaging under and lifting (or otherwise capturing) the upper engagement surface 42 of a residential refuse collection cart 32. By "capture", it is intended to encompass engagement or positioning of the hooks with respect to the engagement surfaces of the cart so that the cart is not inadvertently released when inverted.

In keeping with one aspect of the present invention, the lifter 30 is provided with a lower hook 62 for selectively engaging over or otherwise capturing the lower engagement surface 42 of a refuse collection cart 32 during its engaging and inverting sequence. Specifically, the lower hook 32 is retracted to a position partially, substantially or entirely behind the face plate 46 when the lifter 30 is in its lower or stowed position, as seen in FIGS. 3 and 4; remains in the retracted position as the lifter passes through its "ready" position for engaging the upper engagement surface of the collection cart with the upper hook 60, as seen in FIGS. 5 and 6; and extends out to capture the lower engagement surface of the refuse collection cart as it moves from the "ready" position to the raised and inverted position, as shown in FIGS. 7 and 8, for dumping the refuse collection cart.

Maintaining the lower hook in the retracted position in the lower, stowed position offers a higher ground clearance than if the lower back were in a fully extended position. Maintaining the lower hook in the retracted position when in the "ready" position may reduce or minimize the scarring or marring of the collection cart 32. In this embodiment, the lower hook 62 only slides down and captures the lower engagement surface of the cart when the lifter 30 is in the rotational dump cycle, and the cart 30 is already lifted well into the air. In addition, the retraction of the lower hook 62 as it moves from the inverted position to the ready position reduces the possibility of the cart 32 being drawn under the sill of the truck by mal-functioning of the latch.

Figures 9, 10:
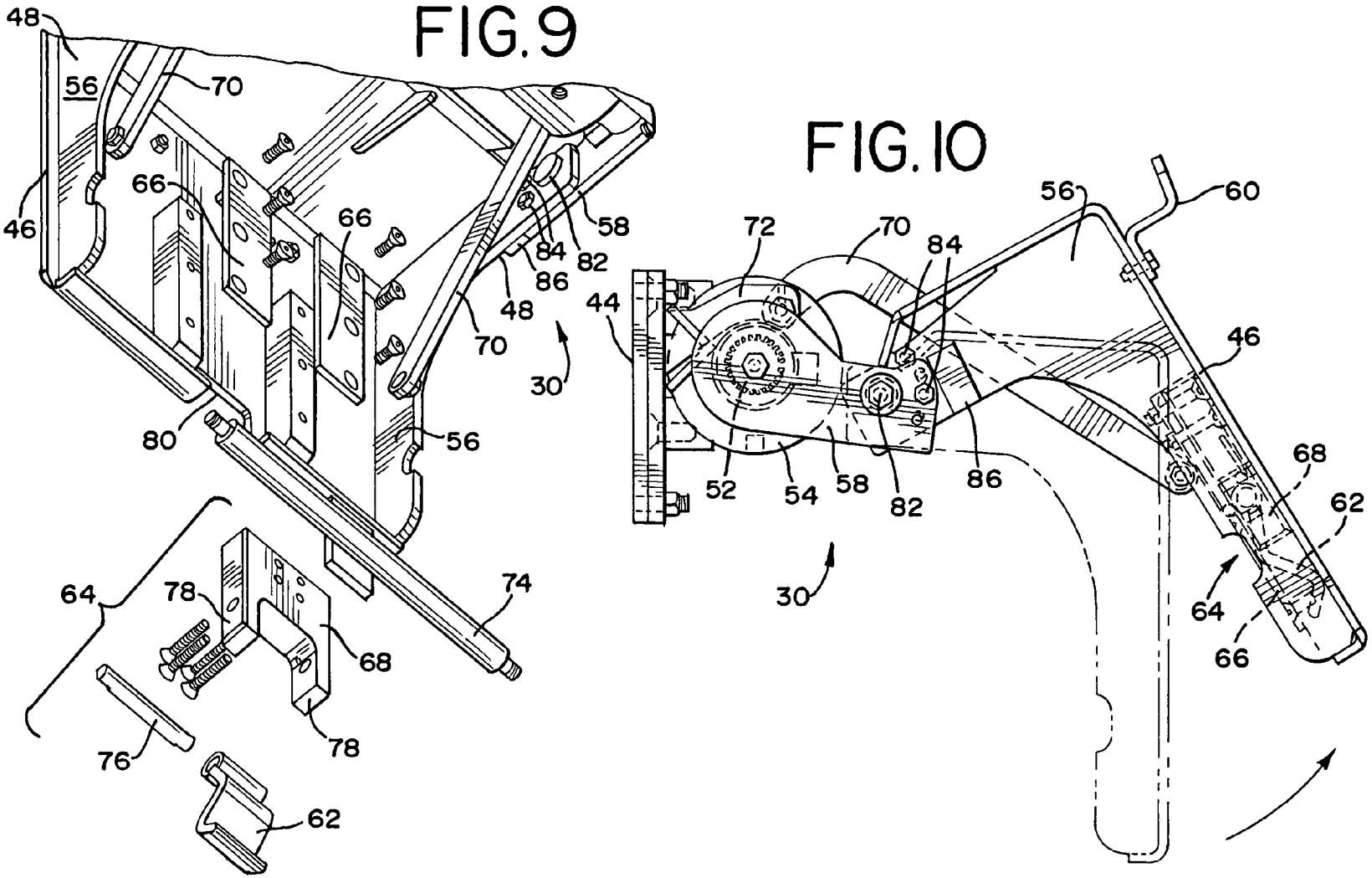
FIG. 9 is an exploded perspective view showing the slide and lower hook assembly for the preferred embodiment of the present invention.
FIG. 10 is a side view of cart lifter in approximately the cart-engaging position showing the optional break-away feature lift arm.

To this end, the lower hook 62 forms part of a latch assembly 64 mounted to the rear surface of the plate 46 (as best seen in FIGS. 8 and 9). The latch assembly 64 comprises a track defined by a pair of opposed flanges 66 which slidably capture a slide block or member 68 that is moveably received there between. As illustrated, each flange 66 comprises an elongated bar secured to the back side of the plate to which a strip of steel plate is secured by bolts to form the over hanging lip of each flange. Alternately, each flange could be a length of angle iron with a generally Z-shaped cross-section, one leg of the Z being secured to the back of the face plate and the other leg of the Z forming the lip of the flange. The slide block 68 is preferably made of a solid composite plastic block which requires no grease or other lubricant for smooth sliding reciprocation along the length of the tracks.

To move the slide block 68 along the track, at least one and preferably a pair of actuator arms 70 are provided that have one end secured to the base and the other end to the slide block. As illustrated, each of a pair of actuator arms 70 has a generally L-shaped configuration with the short leg of the L being pivotally mounted to a bracket 72 that is attached to the base plate by, e.g., welding or a bolted arrangement. The other end of the actuator arm is pivotally secured to the slide block by means of a cross bar 74 mounted to the slide block. Alternatively, the upper end of the actuator arm could be pivotally secured to the actuator housing. Self-lubricating bushings may be provided between the ends of the actuator arms and the cross bar to provide for a greaseless operation.

The lower hook 62 is pivotally mounted to the slide block 68 by means of a hinge pin 76 received in apertures in the two opposed arms 78. The lower hook is biased towards cart engaging position by means of, e.g., a spring.

Thus, as the cart lifter moves from the lower, stowed position to the "ready" position the slide block moves along the track, the lower hook being maintained in position behind or on the backside of the face plate. As the lifter moves from the "ready" position through the inverted position, the slide block continues to move down the track and the lower hook moves beyond the edge of the face plate. At this point, the lower hook moves (rotates) to project beyond the plane of the face plate due to its being biased in that direction, so that it is in position to capture the lower engagement surface of the collection cart. In the illustrated embodiment, the face plate 46 includes a cut-out 80 on its lower portion sized to receive the extended lower hook 62.

To minimize the overall width of the lifting device, the bracket 72 or support arm for the actuator arms 70 is preferably carried on the base plate so as to be inboard of the end of the rotatable output shaft 52.

In keeping with another feature of the invention, the lift arms 48 may optionally provide for a break-away feature that increases the chances of lifter survival in the event the refuse truck bottoms-out, or the lifters are otherwise forcibly impacted by road debris or the like during operation of either the truck or the lifter. To this end, the lower or outer portion 56 of the lift arm is pivotally mounted to the upper or inner portion 58 of the lift arm by means of a heavy-duty pivot bolt 82. In addition, the lower portion 56 of the lift arm is secured to the upper portion 58 of the lift arm by one and preferably two shear bolts 84 that will be sheared off in the event of impact, thus permitting the carriage to pivot about the pivot bolt 82, as shown in FIG. 10. Although illustrated with shear bolts, the breakaway feature may employ other force-relief structures that allow relative movement between mechanical parts when an external face exceeds a certain threshold. For example, in place of the shear bolts, detent arrangement could be used wherein one portion of the lift arm includes a raised curved protruding surface and the other portion includes a mating recess or dimple. The curved surface and dimple could be forcefully disengaged when the lifter hits an obstruction or bottoms out. The break-away structure may also utilize aspects of the break-away design described in U.S. patent application Ser. No. 10/102,060, filed Mar. 20, 2002, by Arrez et al., which is hereby incorporated by reference in this description.

To maintain proper alignment of the upper and lower portions of the lift arm, the lower portion 56 carries an alignment block 86 on its outer face that abuts the end of the upper portion of the lift arm. As can be appreciated, the alignment block 86 also permits rotation of the carriage about the pivot in only one direction, counter-clockwise as seen in FIG. 10, thus providing greater support for the lower portion of the lift arm when it moves towards inverted position as it lifts a refuse receptacle.

Thus, a cart lifter has been provided that represents a significant advance. While the invention has been shown and described in terms of a preferred embodiment, it should be realized that are many modifications, substitutions and alterations possible without departing from the scope of the claims. For example, the face plate need not be a continuous plate, and other face plate and carriage arrangements may be employed in keeping with the present invention.

What is claimed is:

1. A lifting device for lifting and inverting a refuse collection container having a body with spaced-apart upper and lower engagement surfaces, the lifting device comprising:

a base;

a face plate pivotally mounted with respect to the base for movement between a first, lower position and a second, raised and inverted position;

a rotary actuator having a rotatable output shaft mounted to the base and operatively attached to the face plate for moving the face plate between the lower and the raised and inverted positions;

a lift member fixedly mounted to the face plate for engaging the upper engagement surface of a refuse collection container; and a latch assembly mounted to the face plate for capturing the lower engagement surface on the refuse collection container, the latch assembly further comprising a track carried by the face plate; a slide movably mounted in the track; a hook pivotally carried by the slide for movement between a position for capturing the lower engagement surface and a retracted position, the hook being biased toward the capturing position; and at least one actuator arm having first and second ends, the first end being pivotally carried by the base and the second end being operatively connected to the slide, and a support arm carried on the base inboard of an end of the rotatable output shaft, the first end of the actuator arm being pivotally mounted to the support arm;

whereby when the face plate is moved from the raised and inverted position to the lower position, the actuator arm moves the slide along the track to cause the hook to engage a portion of the face plate to move the hook to the retracted position.

2. The lifting device of claim 1 further comprising a lift arm that connects the output shaft of the rotary actuator to the face plate.

3. The lifting device of claim 1 further comprising a spring for biasing the hook toward the position for engaging a lower engagement surface of a refuse collection container.

4. A lifting device for lifting and inverting a refuse collection container having a body with spaced-apart upper and lower engagement surfaces, the lifting device comprising:

a base;

a support carried on the base;

a lift member for engaging the upper engagement surface of a refuse collection container;

a hook for capturing the lower engagement surface on the refuse collection container, the hook being pivotally movable between a position for capturing the lower engagement surface and a retracted position, the hook being biased toward the capturing position;

a rotary actuator having a rotatable output shaft mounted to the base and operable to move the lift member and hook in unison between a first, lower position and a second raised and inverted position by rotation of the output shaft;

at least one actuator arm having first and second ends, the first end being pivotally mounted to the support carried by the base inboard of an end of the rotatable output shaft and the second end being operatively connected to the hook, whereby when the lift member and hook are moved from the raised and inverted position to the lower position, the actuator arm moves the hook to the retracted position.

5. The lifting device of claim 4 further comprising a lift arm that connects the output shaft of the rotary actuator to the hook.

6. The lifting device of claim 4 further comprising a spring for biasing the hook toward the position for engaging a lower engagement surface of a refuse collection container.

* * * * *